US007952547B2

(12) United States Patent
Wei

(10) Patent No.: US 7,952,547 B2
(45) Date of Patent: May 31, 2011

(54) LIQUID CRYSTAL DISPLAY

(75) Inventor: Lin-Chieh Wei, Padeh (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1049 days.

(21) Appl. No.: 11/790,022

(22) Filed: Apr. 23, 2007

(65) Prior Publication Data

US 2008/0055215 A1 Mar. 6, 2008

(30) Foreign Application Priority Data

Sep. 5, 2006 (TW) ..... 95132727 A

(51) Int. Cl.
*G09G 3/36* (2006.01)

(52) U.S. Cl. ..... 345/87; 345/95; 345/100; 345/205

(58) Field of Classification Search ..... 345/87–100, 345/204–205

See application file for complete search history.

(56) References Cited

U.S. PATENT DOCUMENTS

| | | | | |
|---|---|---|---|---|
| 5,742,261 | A * | 4/1998 | Yuki et al. | 345/3.3 |
| 6,603,452 | B1 * | 8/2003 | Serita | 345/88 |
| 6,933,917 | B2 * | 8/2005 | Chung et al. | 345/98 |
| 7,176,869 | B2 * | 2/2007 | Kumada et al. | 345/94 |
| 7,450,098 | B2 * | 11/2008 | Lee et al. | 345/89 |
| 2004/0017343 | A1 * | 1/2004 | Adachi et al. | 345/87 |
| 2005/0018121 | A1 | 1/2005 | Jen et al. | |
| 2007/0242009 | A1 * | 10/2007 | Su | 345/87 |

* cited by examiner

*Primary Examiner* — Kimnhung Nguyen
(74) *Attorney, Agent, or Firm* — Jianq Chyun IP Office

(57) ABSTRACT

A liquid crystal display includes a first substrate. A plurality of scan lines and a plurality of data lines are disposed on the first substrate to define a plurality of pixel regions. A plurality of common line groups is disposed on the first substrate, and each of the common line groups includes a plurality of common lines parallel to the scan lines. And, at least, a voltage regulator is electrically connected to one of the common line groups, wherein the voltage regulator can stabilize the pixel voltage to decrease the flicker of the liquid crystal display.

10 Claims, 7 Drawing Sheets

LIQUID CRYSTAL DISPLAY

FIELD OF THE INVENTION

This invention relates to a liquid crystal display (LCD), especially, which includes at least a voltage regulator to diminish the flickering.

BACKGROUND OF THE RELATED ART

A liquid crystal display (denoted LCD) drives a plurality of active devices, such as thin film transistors, by a plurality of scan lines and writes data into the pixel electrodes by the data lines. The different lengths of the wires dissipate and delay the voltage waveforms so that a wrong data is written into the pixel electrodes. Additionally, a parasitical capacitor caused by the material or manufacturing also distorts the voltage waveforms by a feedthrough voltage generated by the parasitical capacitor. It is impossible to fix and unify the feedthrough voltage during manufacturing, so how to conquer the feedthrough voltage to diminish the flicker of a LCD is important.

FIG. 1 is a diagram showing the equivalent circuit of part of a known TFT-LCD. Gate driver 200 drives the scan lines G1 . . . Gn−1 sequentially to switch on the thin film transistors (denoted TFTs), and the source driver 100 writes a data (voltage) to the data lines S1 . . . Sn−1. For example, a scan line G1 and a data line S1 electrically connect to a TFT 400 of a pixel, in which the gate electrode, the source electrode and the drain electrode of the TFT 400 connect to the scan line G1, data line S1 and pixel electrode respectively. The pixel includes a storage capacitor (Cst) 410 and a liquid crystal capacitor (Clc) 420, and the storage capacitor (Cst) 410 maintains the voltage on the pixel electrode until that the scan driver drives the scan line again, and the liquid crystal capacitor (Clc) 420 provides a voltage across the liquid crystal in the pixel. The pixel electrode couples a common electrode to form the liquid crystal capacitor (Clc) 420 to provide the voltage across the liquid crystal, which is pixel voltage.

FIG. 2 is a diagram showing the equivalent circuit of a pixel. The gate electrode connects to a scan line 210, the source electrode connects to a data line 110, and the drain electrode connects to a pixel electrode to write the data into the pixel electrode. As shown in the diagram, there exists a parasitical capacitor between the gate electrode and the drain electrode of the TFT 400.

FIG. 3 is a diagram of voltage waveforms illustrating the voltage variation of a pixel electrode. When the scan line voltage 440 raises from Vgl to Vgh to switch on a TFT 400, the data line voltage 450 charges the pixel electrode during a duty time Ton, so the pixel voltage 460 rises up from Vdl to Vdh. After the duty time Ton, the scan line voltage 440 goes down to Vgl to switch off the TFT, and the data line voltage 450 falls from Vdh to Vdl. Since the storage capacitor holds the pixel voltage 460, so the pixel voltage 460 does not fall to Vdl. Theoretically, the pixel voltage 460 should hold at Vdh, but a parasitical capacitor Cgd pulls down the pixel voltage 460 for a feedthrough voltage ΔVp. The voltage difference between the pixel voltage and the common voltage 470 on the common lines shifts for a feedthrough voltage ΔVp to flicker the screen of a TFT-LCD.

For diminishing or vanishing the flicker, US. App. No. 2005/0018121 discloses a teaching of zigzagging the wires between data lines and source driver or between scan lines and gate driver to a similar length to cancel out the wire delay, but does not eliminate the parasitical capacitor.

Next, U.S. Pat. No. 6,933,917 discloses a teaching of connecting the scan lines to control circuits to provide impedance. Each control circuit connects a scan line to a transistor, where the gate electrode of the transistor connects a variable resistor and then to a power supply, one electrode to a common line. The impedance generated by the control circuit is much larger than that generated by the TFT of a pixel, so that, in relatively, the impedance generated by the TFT of a pixel can be neglected almost. It means the feedthrough voltage ΔVp decreases relatively to diminish the flicker.

The feedthrough voltage ΔVp varies from pixel to pixel, so the same impedance cannot diminish all flickers on the screen of a TFT-LCD. It is still an important topic to develop a new skill to solve this problem.

SUMMARY OF THE INVENTION

An object of this invention provides a LCD, which connects at least a voltage regulator, and the voltage regulator adjusts the common voltage to cancel out the feedthrough voltage to vanish the flicker.

Another object of this invention provides a method of adjusting a voltage regulator to vanish or diminish the flicker.

According to an embodiment of this invention, a liquid crystal display includes a first substrate; a plurality of scan lines and a plurality of data lines disposed on the first substrate to define a plurality of pixel regions thereon; a plurality of common line groups disposed on the first substrate and essentially parallel to the scan lines, wherein each of the common line groups includes a plurality of common lines; at least a voltage regulator electrically connected to one of the common line groups; and a second substrate opposed to the first substrate.

A voltage regulator, according to an embodiment of this invention, includes an inverting adder and a resistor. The inverting adder includes a positive input connected to the ground wire, a negative input and an output, where the resistor connects the negative input and the output, and the negative input connects to the common lines. The output provides a compensative voltage varying with the resistor, so that the resistor adjusts the compensative voltage. When the output connects to the compensative point, the compensative voltage will adjust the voltage on the compensative point, in this example, the compensative point is electrically connected to one of common lines in one of common line groups. When the voltage regulator provides an optimized compensative voltage, the flicker on the screen of the LCD will be diminished to the minimum or vanished.

According to an embodiment of this invention, a method of adjusting voltage regulators connected to a TFT-LCD diminishes or diminishes the flicker on the screen of a LCD. The first step is to detect the screen for a flicker. If the flicker occurs on the screen, then the resistance of the resistor of the voltage regulator is reset to a new value; if not, the resistance of the resistor is retained. When the flicker is minimal, the resistance of the resistor is the optimal resistance. Like that, when all areas of the screen of the LCD are optimized, the LCD is optimized.

DETAILED DESCRIPTION OF THE INVENTION

A liquid crystal display (LCD) includes a first substrate. The first substrate includes a plurality of scan lines and data lines to define a plurality of pixel regions thereon, and a common line is disposed to correspond to a pixel region. A plurality of common line groups are disposed on the first substrate and essentially parallel to the scan lines, wherein each of the common line groups includes a plurality of common lines. Each of the pixel regions includes an active device, such as a TFT, and a pixel electrode, where the pixel electrode opposes to a corresponding common line. The gate electrode, the source electrode and the drain electrode of the TFT connect a scan line, a data line and a pixel electrode respectively. When the gate voltage on the scan line switches on the TFT, the source voltage (data) on the data line is written into the pixel electrode. A voltage on each of common lines in one of common line group provides the common voltage Vcom, and the unstable common voltage Vcom flickers the screen of the LCD. The common lines connect to a voltage regulator, and the voltage regulator provides a stable common voltage Vcom to diminish the flicker.

The following employs the drawings and embodiments to illustrate this invention.

Figure 1:
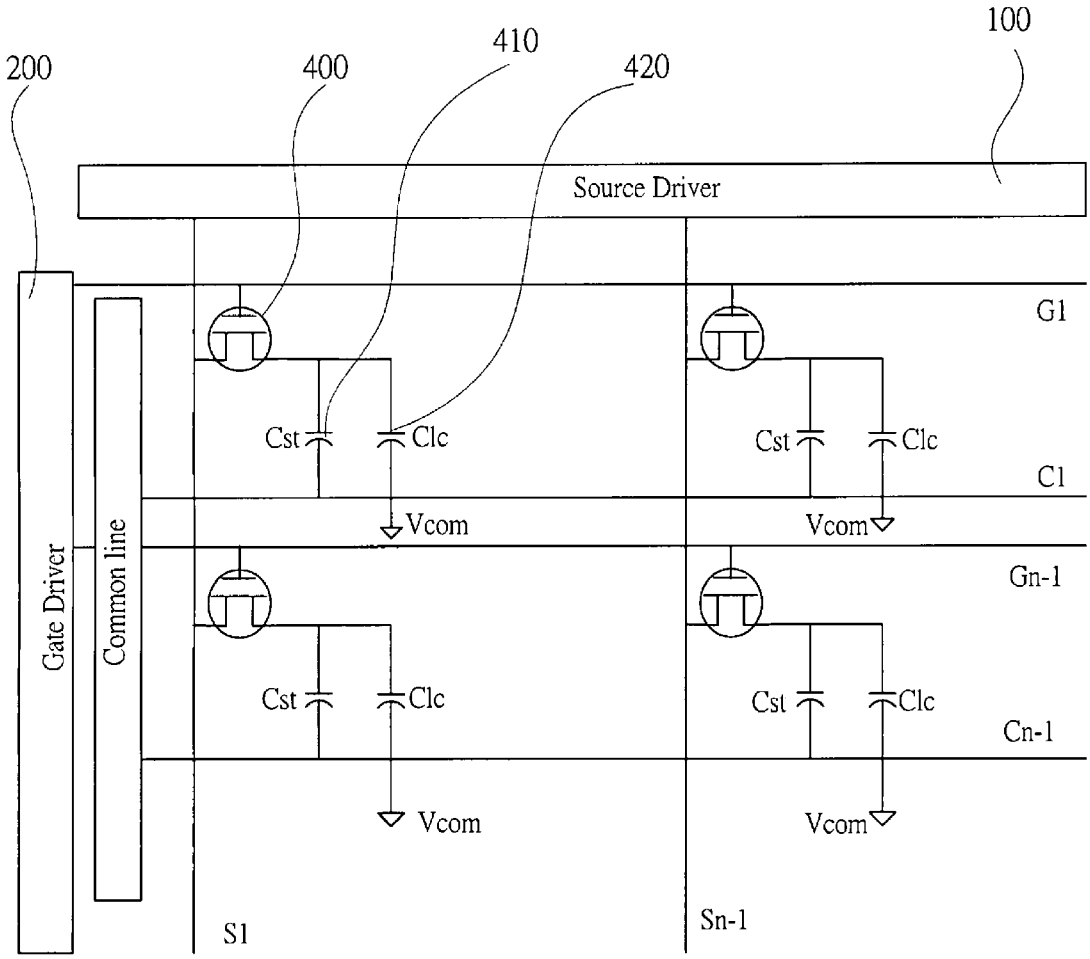
Fig.1(Prior Art)
FIG. 1 is a diagram showing the equivalent circuit of a conventional TFT-LCD.
Figure 2:
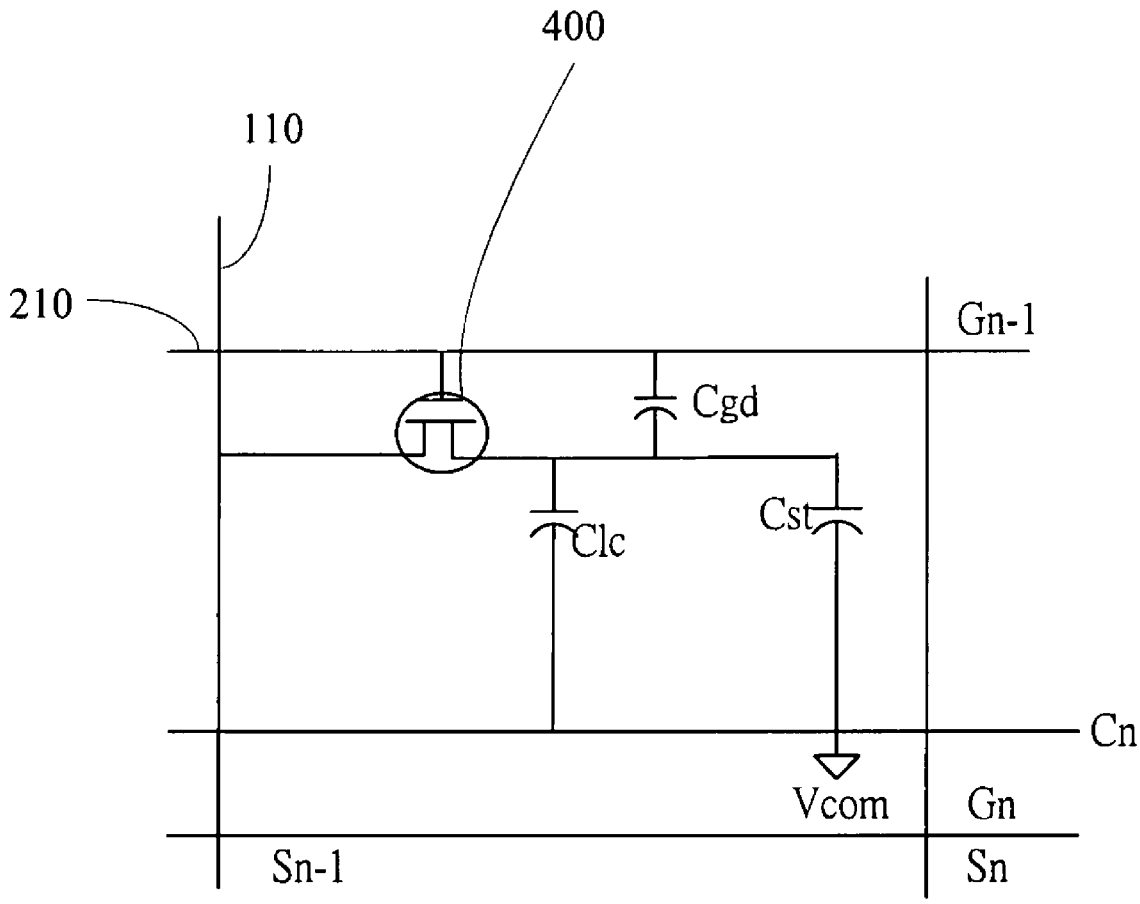
Fig.2(Prior Art)
FIG. 2 is a diagram showing the equivalent circuit of a single pixel of a conventional TFT-LCD.
Figure 3:
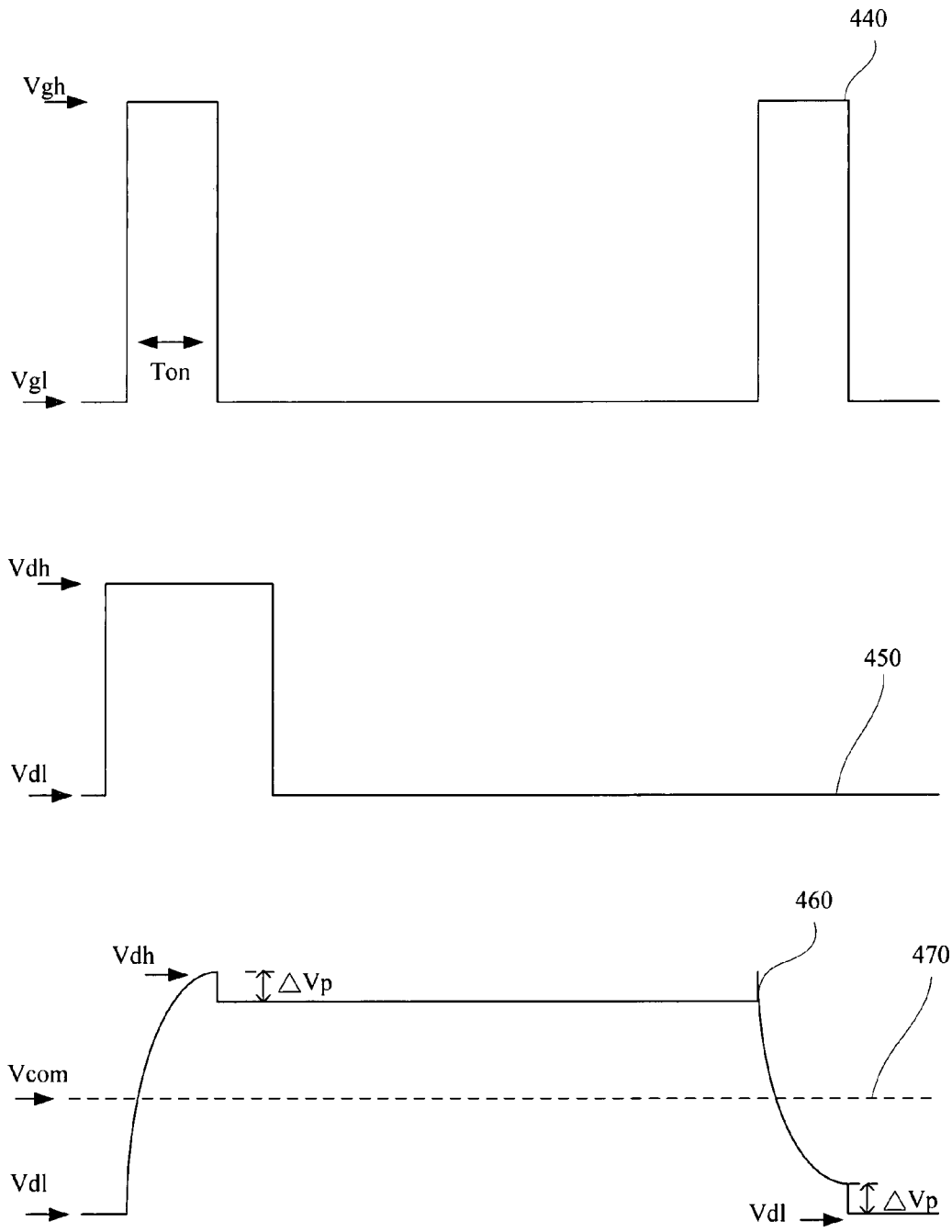
Fig.3(Prior Art)
FIG. 3 is a diagram showing the voltage waveform of a single pixel of a conventional TFT-LCD.
Figure 4:
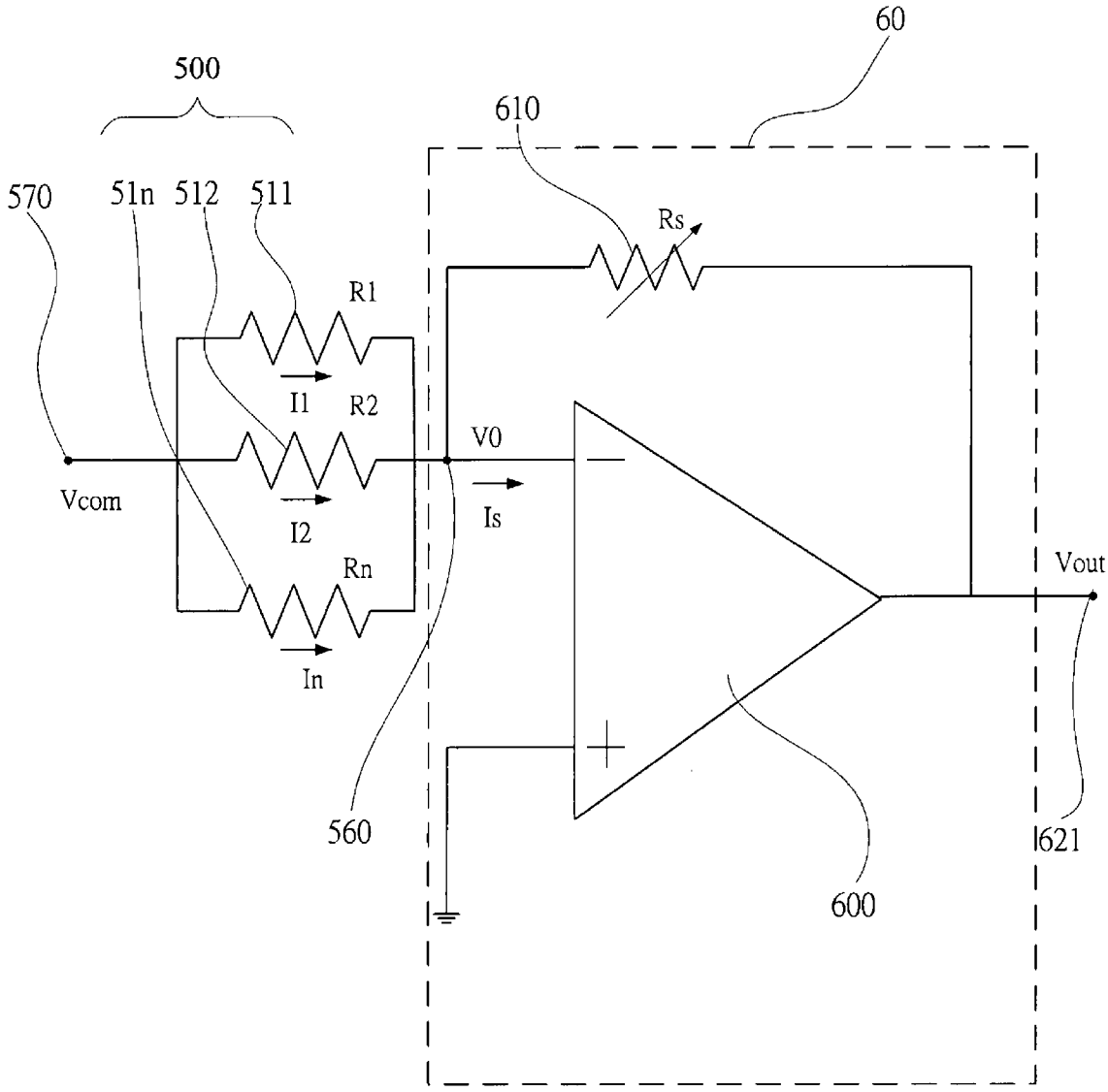
FIG. 4 is a diagram showing the equivalent circuit of a TFT-LCD according to an embodiment of this invention, where the circuit of the TFT-LCD connects to a voltage regulator.

FIG. 4 is a diagram showing the equivalent circuit of a TFT-LCD according to an embodiment of this invention, where the TFT-LCD connects to a voltage regulator. An input end 570 provides a common voltage Vcom to a common line group 500, which includes many common lines 511, 512 . . . 51*n*. R1, R2 . . . Rn represent the intrinsic impedance of the common lines 511, 512 . . . 51*n*, and I1, I2 . . . In represent the current through R1, R2 . . . Rn and converge at a monitor point 560. The monitor point 560 connects to the input of a voltage regulator 60, and the output of the voltage regulator 60 connects to a compensative point; in general, the compensative point is a common line or the monitor point 560.

The voltage regulator 60 includes an inverting adder 600 and a variable resistor Rs 610, wherein the inverting adder 600 includes a positive input connected to a ground wire, a negative input and an output 621, and the variable resistor Rs 610 connects across the negative input and the output 621. The negative input and the output 621 are the input and the output 621 of the voltage regulator 60, where the output 621 provides a compensative voltage.

The common lines 511, 512 . . . 51*n* have various intrinsic impedances caused by the manufacture or various lengths of the common lines 511, 512 . . . 51*n*, as shown as R1, R2 . . . Rn in FIG. 5. The currents I1, I2 . . . In pass the R1, R2 . . . Rn, and converge at a monitor point 560. The total current is Is=I1+I2+ . . . +In and the voltage is V0 at the monitor point 560.

The compensative voltage on the output 621 of the voltage regulator 60 is Vout, and the current passing the variable resistor 610 is Is. The relation between Is and Vout is represented by Is=(V0−Vout)/Rs or Vout=V0−IsRs.

The output 621 of the inverting adder 600 connects a compensative point, maybe a common line or the monitor point 560. Like that, the compensative voltage Vout adjusts the voltage on the compensative point. Once the flicker occurs on the screen of the TFT-LCD, the resistance of the variable resistor Rs 610 of the voltage regulator 60 is reset to diminish the flicker down to the minimum to improve the quality of the screen, and the adjusting method will be explained later.

For example, in an ideal condition, the flickering phenomenon does not occur. The common voltage Vcom=5V (volts), the voltage V0 on the monitor point 560=0V and the net resistance of the impedance R1,R2 . . . Rn of the common lines 511, 512 . . . 51*n*=1Ω (ohms) are assumed. It can be deduced that Is=5 A (amperes) and Vout=IsRs−V0=5V.

When the distortion of the common voltage Vcom results in flickering, such as Vcom becomes 3V, and the net resistance of the impedance R1, R2 . . . Rn of the common lines 511, 512 . . . 51*n*=1Ω (ohms) retains at 1Ω due to the characteristic of semiconductor, the current reduces to 3 A. The resistance of the variable resistor Rs is reset to 5/3Ω(ohms) to hold the compensative voltage Vout at 5V, and then Vout compensates the voltage on the compensative point. In this example, the compensative point is electrically connected to one of common lines in one of common line groups, and the common voltage Vcom is adjusted to 5V, so that the common voltage Vcom is stabilized to diminish the flicker.

Figure 5:
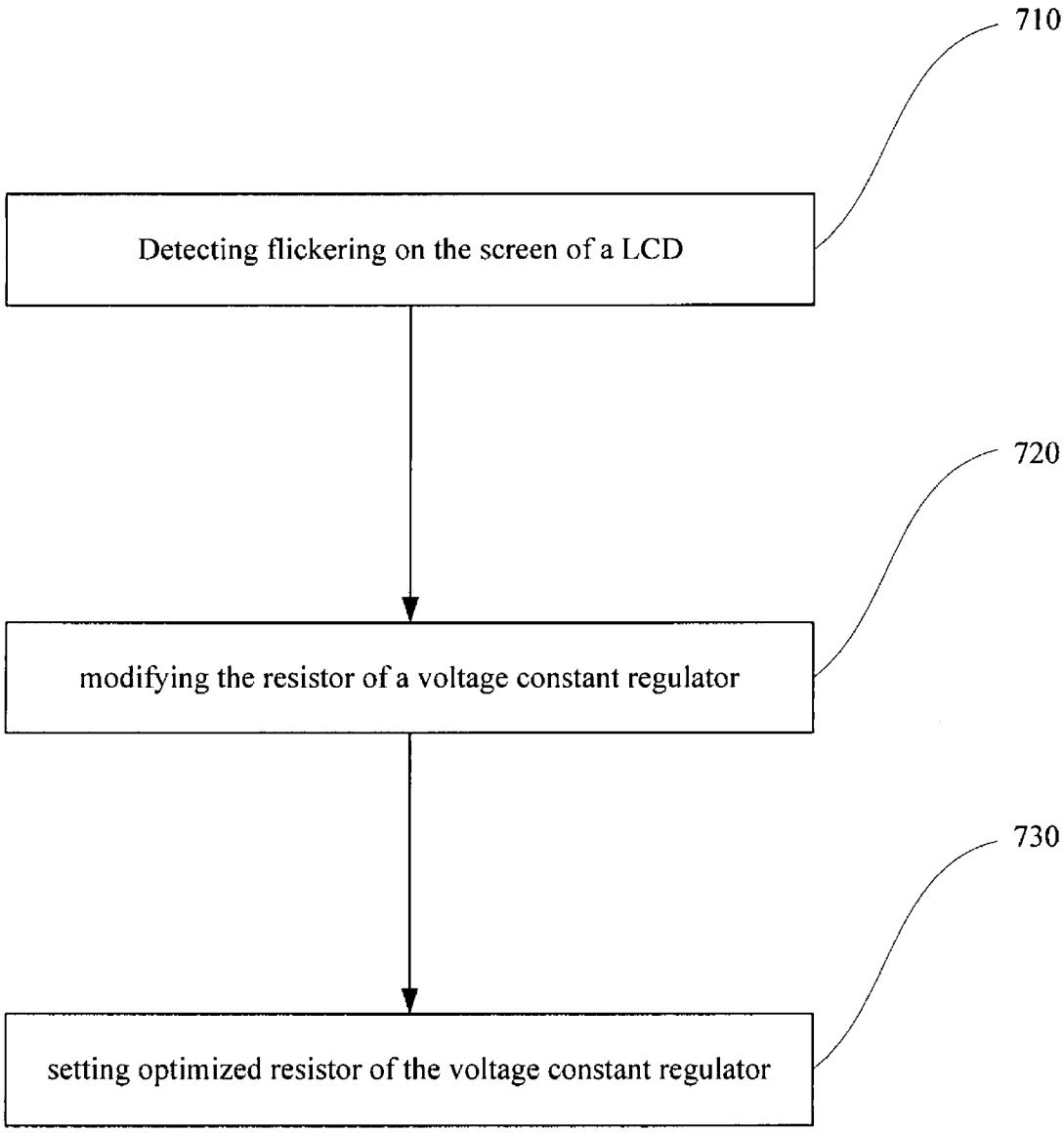
FIG. 5 is a flow chart illustrating a method of adjusting the voltage regulator to diminish the flicker on the screen of a TFT-LCD according to an embodiment of this invention.

The following, refer to FIG. 5, explains the adjusting method for optimizing the variable resistor Rs.

Step 710 is to detect the screen for a flicker. If the flicker occurs then the resistance of the variable resistor Rs should be reset; if not, the Rs should be retained.

Step 720 is to adjust the resistance of the variable resistor Rs to find out the optimal resistance, which should diminish the flicker down to the minimum or diminish the flicker.

Step 730 is to reset the resistance of the variable resistor Rs to the optimal resistance.

Figure 6:
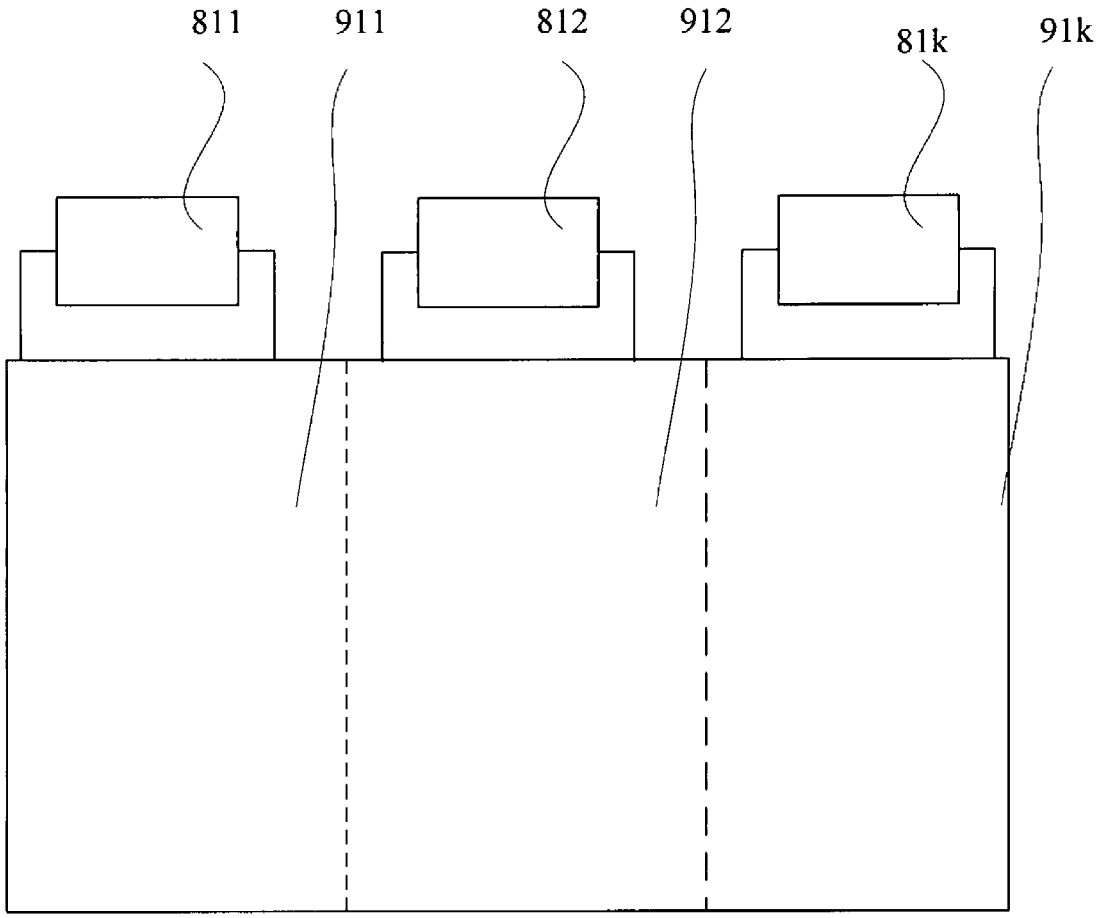
FIG. 6 is a diagram showing the screen of a TFT-LCD according to an embodiment of this invention, where the screen includes many areas.

FIG. 6 is a diagram showing many voltage regulators applied to a TFT-LCD, according to an embodiment of this invention, where the TFT-LCD includes many areas 911, 912 . . . 91*k*, and each area corresponds to a common line group, and a common line group connects to a voltage regulator, where the voltage regulators are shown as 811, 812 . . . 81*k*.

Figure 7:
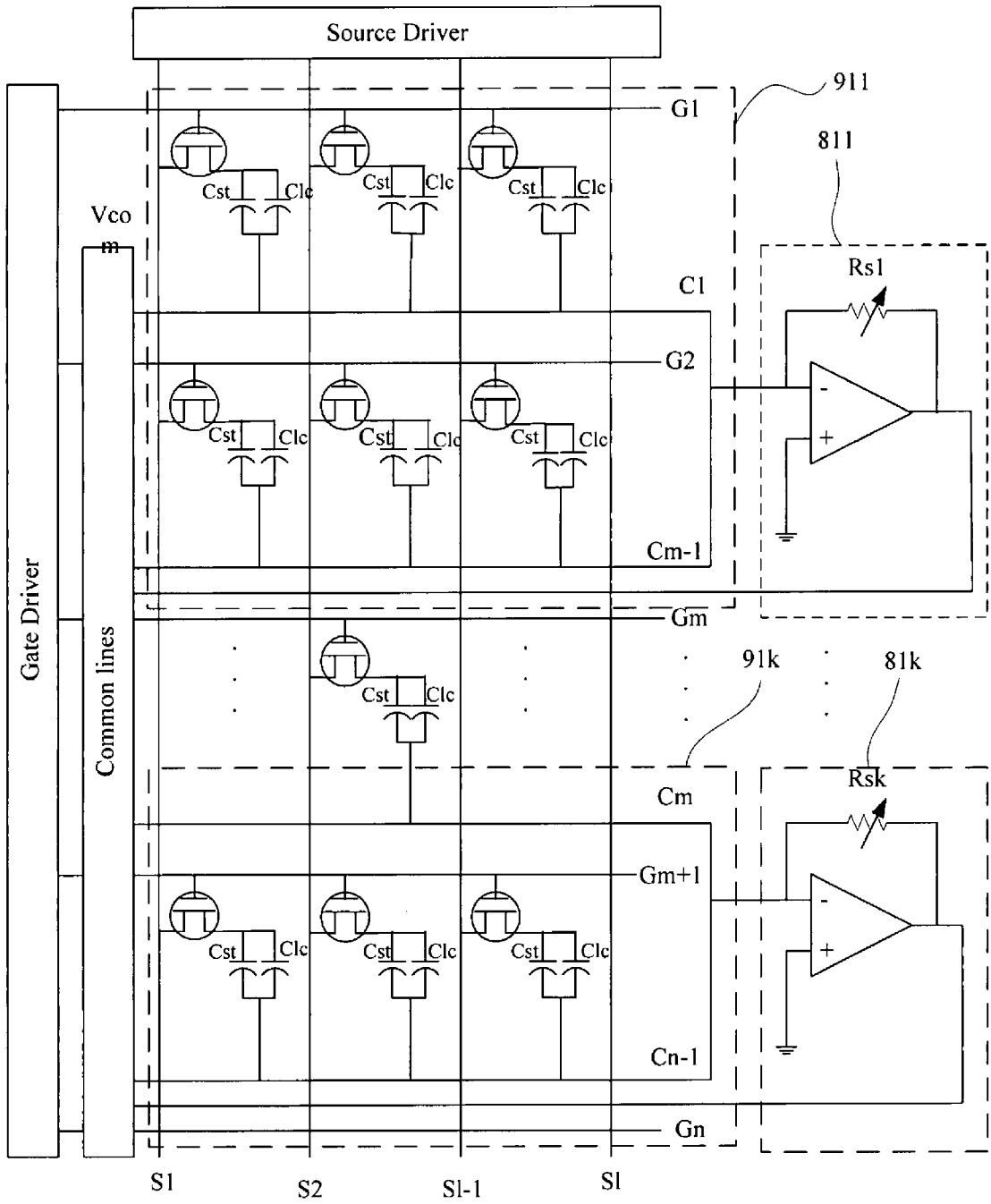
FIG. 7 is a diagram showing the equivalent circuits of a TFT-LCD according to an embodiment of this invention, where each equivalent circuit corresponds to an area on the screen.

FIG. 7 shows the equivalent circuits of the various areas of a TFT-LCD shown in FIG. 6. The voltage regulators 811, 812 . . . 81*k* and the areas 911, 912 . . . 91*k* in FIG. 7 are corresponding to the 811, 812 . . . 81*k* and 911, 912 . . . 91*k* in FIG. 6 respectively, where FIG. 7 shows out the equivalent circuits of the voltage regulators 811, 812 . . . 81*k*.

Refer to FIG. 7, G1, G2 . . . Gm, Gm+1 . . . Gn represent scan lines, S1, S2 . . . SI−1,SI represent data lines and C1, C2 . . . Cm−1, Cm . . . Cn represent common lines. The common lines are grouped and parallel connected to form k common line groups corresponding to k areas on the screen in FIG. 6. Each of the common line groups includes at least one common line, but different common line groups may have the different amount of common lines. Each of the common line groups connects to a voltage regulator, and the voltage regulators compensate the common voltages Vcom1, Vcom2 . . . Vcomk corresponding to areas of the screen.

For each area of the screen, the resistor of each voltage regulator is adjustable independently to diminish the flicker down to the minimum or diminish the flicker. It is obvious that the resistor of a different voltage regulator may have a different resistance. When flicker on each area of the screen of a TFT-LCD is diminished to minimum or vanished, the TFT-LCD is optimized.

Although the present invention has been explained in relation to its preferred embodiment, it is to be understood that other modifications and variation can be made without departing the spirit and scope of the invention as claimed.

What is claimed is:

1. A liquid crystal display, comprising:

a first substrate;

a plurality of scan lines and a plurality of data lines disposed on the first substrate to define a plurality of pixel regions thereon;

a plurality of voltage regulators;

a plurality of common line groups disposed on the first substrate and essentially parallel to the scan lines, each of the common line groups comprises a plurality of common lines and the common line groups are connected to the voltage regulators respectively;

a plurality of pixels, wherein each of the pixels is configured on each of the pixel regions, and the pixels are connected to the common lines, and the pixels connected to the same common line in the same common line group are connected to only one common line and the pixels connected to the common lines belonging to different common line groups do not connect to the same common line; and a second substrate opposed to the first substrate.

2. A liquid crystal display according to claim 1, wherein each of the voltage regulators comprises an inverting adder and a resistor.

3. A liquid crystal display according to claim 2, wherein the resistor is a variable resistor.

4. A liquid crystal display according to claim 2, wherein the inverting adder comprises a positive input, a negative input and an output, wherein the positive input connects a ground wire, the negative input connects the resistor, and the output connects the resistor and a compensative point.

5. A liquid crystal display according to claim 4, wherein the compensative point is connected to one of the common lines in one of common line groups.

6. A liquid crystal display according to claim 1, wherein each of the pixel regions comprises an active device and a pixel electrode therein, wherein the active device is electrically connected to one of the data lines and scan lines and the pixel electrode is electrically connected to the active device.

7. A liquid crystal display according to claim 1, wherein the amount of the common lines of any two of the common line groups are the same or different.

8. A liquid crystal display according to claim 1, wherein any two of the voltage regulators have identical or different resistances.

9. A liquid crystal display according to claim 1, wherein the first substrate is an active matrix substrate.

10. A liquid crystal display according to claim 1, wherein the second substrate is a color filter substrate.

* * * * *